United States Patent [19]

Silva

[11] Patent Number: 4,998,302

[45] Date of Patent: Mar. 12, 1991

[54] SELF-CONTAINED MOBILE HYGIENE CABINET

[76] Inventor: Michael L. Silva, 16900 Old Ranch Rd., Los Gatos, Calif. 95030

[21] Appl. No.: 379,912

[22] Filed: Jul. 14, 1989

[51] Int. Cl.[5] ..... A45D 19/04

[52] U.S. Cl. ..... 4/516

[58] Field of Search ..... 4/516, 518

[56] References Cited

U.S. PATENT DOCUMENTS

| | | | |
|---|---|---|---|
| 2,471,302 | 5/1949 | Boward | 4/588 |
| 2,850,742 | 9/1958 | Glintz | 4/516 |
| 3,013,280 | 12/1961 | Coffman et al. | 4/516 |
| 3,192,537 | 7/1965 | Coffman et al. | 4/516 |
| 3,416,517 | 12/1968 | Adams et al. | 4/516 X |
| 3,894,546 | 7/1975 | Nolan | 4/516 X |
| 4,935,971 | 6/1990 | Dunn et al. | 4/516 X |

FOREIGN PATENT DOCUMENTS

| | | | |
|---|---|---|---|
| 486766 | 11/1953 | Italy | 4/578 |

*Primary Examiner*—Charles E. Phillips

*Attorney, Agent, or Firm*—Phillips, Moore, Lempio & Finley

[57] ABSTRACT

A highly stable and self-contained mobile hygiene cabinet comprises a housing assembly mounted on a plurality of wheels and a wash basin mounted on a top of the cabinet. First and second tanks are mounted centrally within the cabinet for retaining cold and hot water therein, respectively. A third tank is also mounted in the cabinet, below the other tanks, and communicates with the basin to receive waste waters therefrom. Water dispensing apparatus, including a manually actuated handle knob and a sprayer attachment, are mounted on the cabinet adjacent to the basin for receiving and dispensing water. A water supply control system selectively communicates cold, hot or a mixture of cold and hot water from one or both of the first and second tanks to the water dispensing means. An electrical control system is provided for selectively driving pumps to effect such communication and to also purge the third tank of waste water. Quick disconnect couplings are provided exteriorly on the cabinet for attachment to a standard tap water faucet to selectively provide an alternative source of hot and cold water to the three tanks.

12 Claims, 3 Drawing Sheets

SELF-CONTAINED MOBILE HYGIENE CABINET

TECHNICAL FIELD

This invention relates to a mobile hygiene cabinet and more particularly to a self-contained cabinet having hot and cold water supplies and a waste tank mounted therein.

BACKGROUND OF THE INVENTION

Bed-ridden patients in hospitals, board and care homes, and convalescent homes require periodic cleansing and grooming. The inability of such patients to move to a bathroom facility for this purpose has dictated the need for a highly stable, mobile and efficient self-contained hygiene cabinet containing the necessary cold and hot water sources and a shampoo bowl or basin for this purpose. In addition, mobile units of this type should be designed for easy operation by a semi-skilled nurse's aide or the like with a minimum of training. Also, the cabinet should be highly serviceable. U.S. Pat. Nos. 2,850,742; 3,013,280; 3,192,537; 3,416,517; and 3,894,546 disclose various types of shampoo apparatus that fail to meet the above, briefly described desiderata.

SUMMARY OF THE INVENTION

An object of this invention is to provide an improved mobile and self-contained hygiene cabinet that is economical to manufacture, exhibits high degrees of stability, mobility and serviceability and that can be operated efficiently by semi-skilled persons having to undergo a minimum amount of training.

The mobile hygiene cabinet of this invention comprises a housing assembly mounted on a plurality of wheels, casters or the like, and a wash basin mounted on a top of the cabinet. First and second tanks are mounted centrally in the cabinet for retaining predetermined quantities of cold and hot water therein, respectively. A third or waste tank is mounted below the other tanks and closely adjacent to a bottom of the cabinet and communicates with the basin for receiving waste waters therefrom. Water dispensing means are mounted on the cabinet, adjacent to the basin, for receiving and dispensing water therefrom under control of an operator. A water supply control system functions to selectively communicate cold, hot or a mixture of cold and hot water from the first and second tanks to the water dispensing means. Quick disconnect couplings are mounted on the cabinet for selective attachment to external hoses for communicating cold and/or hot tap water to the water dispensing means and to the waste tank.

In another aspect of this invention, an electrical control means, including individual switches, functions to control operation of the pumps and visually indicate when the water in each of the tanks falls below a predetermined level.

BRIEF DESCRIPTION OF THE DRAWINGS

Other objects and advantages of this invention will become apparent from the following description and accompanying drawings wherein.

DESCRIPTION OF THE PREFERRED EMBODIMENT

General Description

Figure 1:
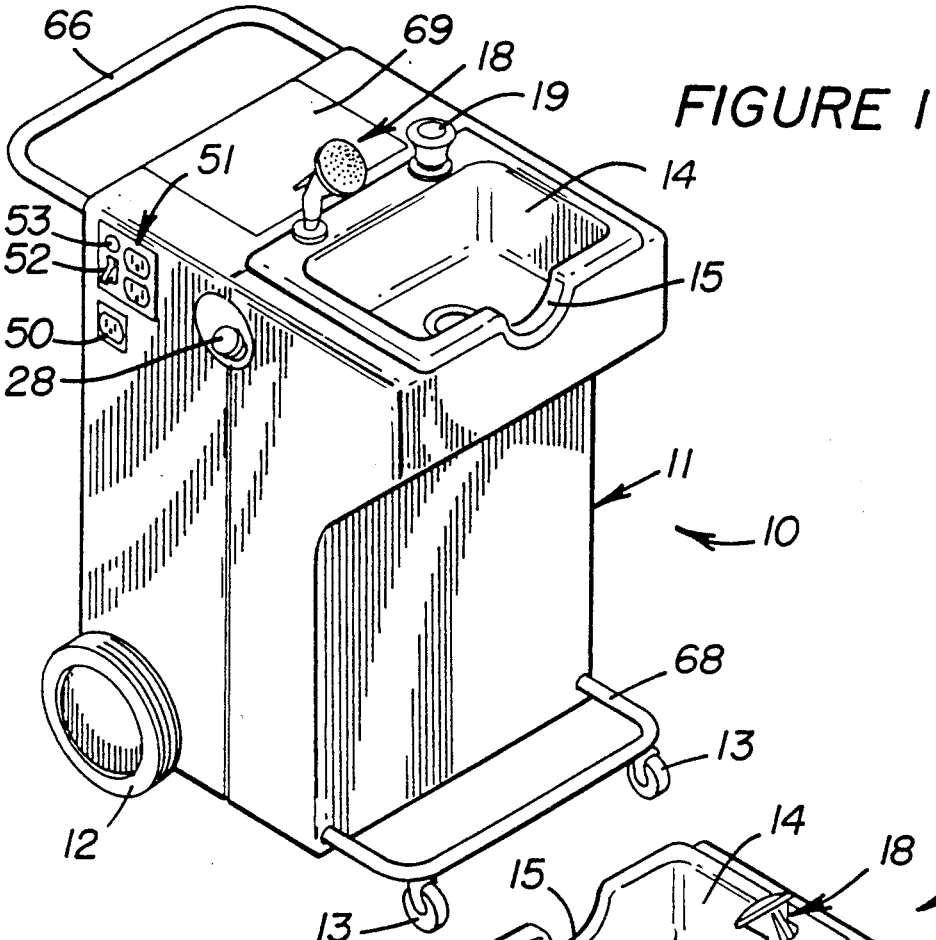
FIG. 1 is a front side isometric view illustrating a self-contained mobile hygiene cabinet embodying this invention.
Figure 2:
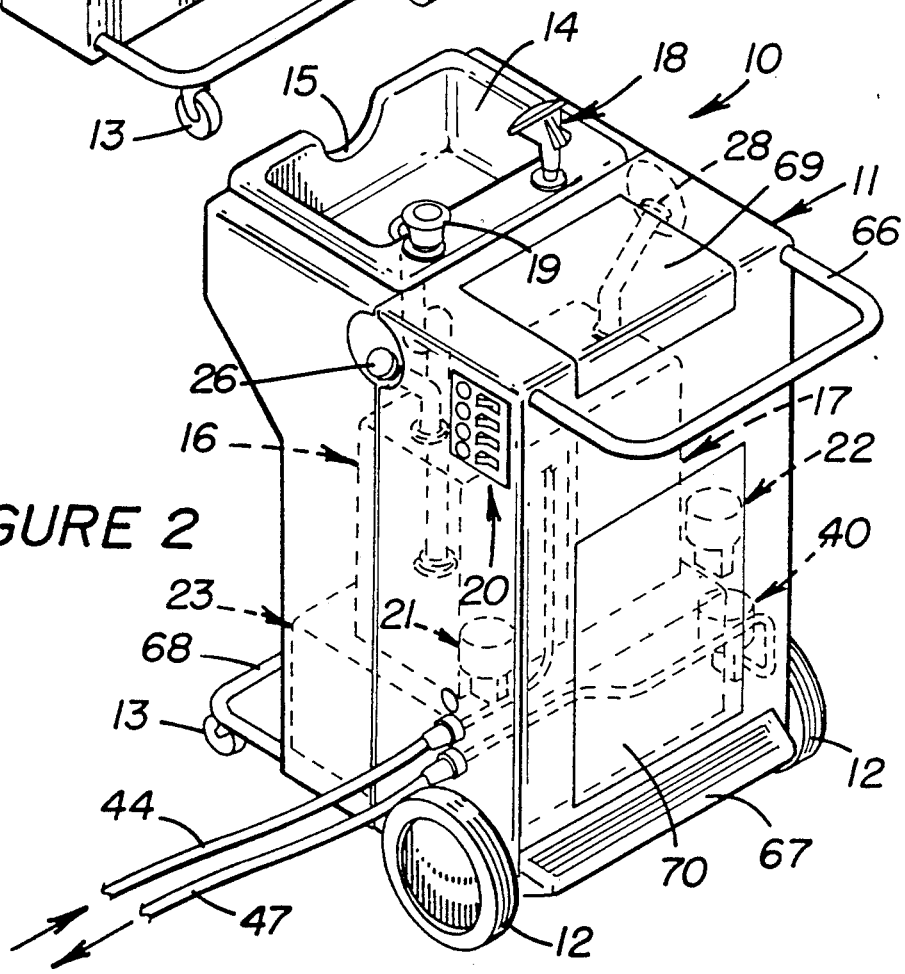
FIG. 2 is a backside isometric view of the cabinet.

FIGS. 1 and 2 illustrate a self-contained mobile hygiene cabinet 10 particularly adapted for use in the cleansing and grooming of bed-ridden patients, such as those confined to hospitals, board and care homes or convalescent homes. For example, the cabinet can be placed at bedside to shampoo a patient's hair or provide a portable station for the purpose of bedside bathing and required prep work, prior to an operation. The cabinet can also be adapted for home use or use in a conventional beauty salon or the like.

The cabinet comprises a housing assembly 11 mounted on a pair of laterally spaced wheels 12 (the term "wheels" as used herein shall include casters, rollers, etc.) and casters or rollers 13. A wash basin or bowl 14 is mounted on a top of the cabinet and has an arcuate recess 15 defined on a frontal side thereof to accommodate the neck or forehead of a patient for shampooing purposes. The cabinet forms a self-contained unit having a cold water or first tank 16 and a hot water or second tank 17 suitably mounted in side-to-side relationship centrally therein.

As described more fully hereinafter, the cold and/or hot water is adapted to be selectively communicated to a water dispensing means, including a sprayer attachment 18 controlled by a single reciprocal and rotatable handle knob 19. The sprayer attachment and knob are both mounted on a rearward side of basin 14. A water supply control system for selectively communicating the hot and/or cold water to the dispensing means includes an operator-controlled switch and light panel 20, mounted on a side of the cabinet as shown in FIG. 2, and a pair of electrically driven pumps 21 and 22 for selectively communicating the cold and hot water, respectively, to the sprayer attachment.

A waste or third tank 23 is also mounted closely adjacent to a bottom of cabinet 10, (FIG. 3), below the cold and hot water tanks, for collecting waste water from basin 14, after shampooing or related patient care procedures. As described more fully hereinafter, an external source of hot and cold tap water, dispensed from a standard sink spout 24, is adapted to be quick-connected to the cabinet to communicate such water to sprayer attachment 18. The tap water can be used in lieu of the water contained in tanks 16 and 17, or used to communicate hot water to waste tank 23 for cleansing u purposes.

DETAILED DESCRIPTION

Figure 3:
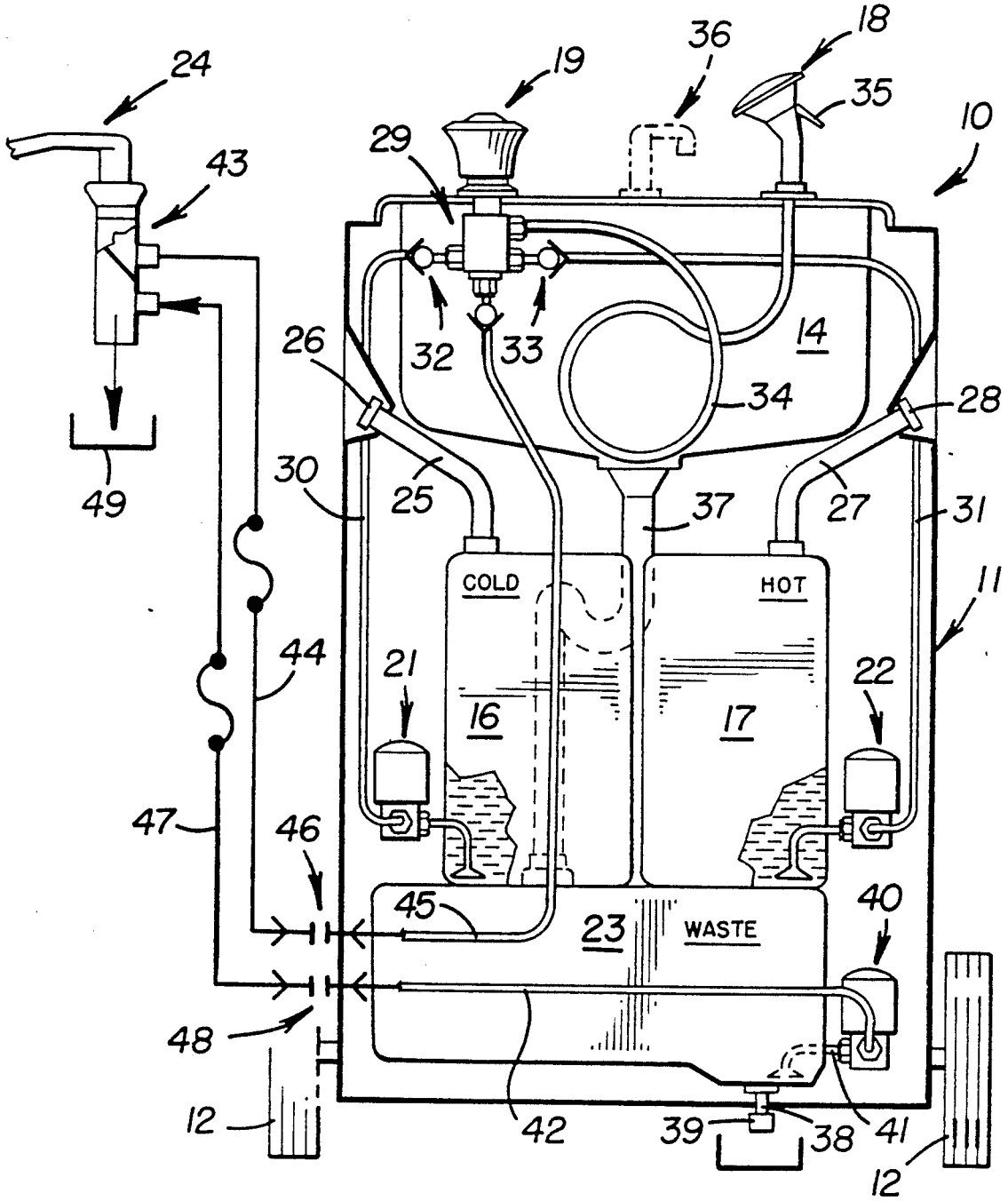
FIG. 3 is a backside elevational view of the cabinet, schematically illustrating a self-contained water supply control system and an alternate external water source connectible thereto.

Referring to FIG. 3, schematically illustrating component parts of the water supply control system of the mobile hygiene cabinet, cold water tank 16 (e.g., four gallon capacity) may be suitably filled via a fill pipe 25, having a cap 26 removably mounted on an open end thereof. Likewise, hot water tank 17 (e.g., four gallon capacity) can be filled via a fill pipe 27, having a removable cap 28 with the capped open ends of the fill pipes being positioned in exposed relationship on opposite lateral sides of the cabinet. Cold water is communicated from tank 16 to a distribution valve 29, upon activation of pump 21, via a supply conduit 30 mounted in the cabinet.

The distribution valve is standard and will function to, in turn, further communicate cold (and/or hot) water to sprayer attachment 18 under control of handle knob 19. Upon activation of pump 22, hot water from tank 17 will be communicated to the distribution valve via a supply conduit 31. Supply conduits 30 and 31 may have standard check valves 32 and 33 therein to block counterflow of water therethrough in a conventional manner.

Distribution valve 29 may be of any standard type, such as the Model 622-A Moen® Flow-Temp distributed by Belvedere Company, Inc. of Rockford, Ill. In this type of valve, rotation of handle knob to a selected adjusted position will function to regulate the temperature of water emitted from sprayer attachment 18 whereas reciprocation of the handle knob will control the quantity of water emitted therefrom. The sprayer attachment includes a flexible hose 34 that will permit the head of the sprayer attachment to be pulled away from the cabinet. A return spring or the like (not shown) can be suitably connected to the hose, within the confines of the cabinet, to automatically retract the sprayer attachment to its FIG. 3 stored position on the cabinet, if so desired.

A standard on-off hand lever 35 is pivotally mounted on the sprayer attachment to open a normally closed valve (not shown), contained in the head of the sprayer attachment, in a conventional manner. As schematically illustrated in FIG. 3, a standard spout 36 can be suitably mounted on the cabinet to overlie basin 14. The spout can be suitably connected to distribution valve 29 for use in addition to or in lieu of sprayer attachment 18, as is well known to those skilled in the plumbing arts relating hereto.

Still referring to FIG. 3, basin 14 communicates with waste tank 23 (e.g., six gallon capacity) via a drain pipe 37. A clean-out drain pipe 38, normally covered by a cap 39, may be secured to a bottom of the waste tank for clean-out purposes. As described more fully hereinafter, a third pump 40 is mounted in the cabinet and has its suction side communicating within the waste tank via a conduit 41 to clean out the tank via a conduit 42, when the latter pump is energized.

A standard faucet attachment 43 is adapted for attachment to spout 24 of a standard bathroom faucet assembly to supply tap water to sprayer attachment 18 as an alternative to the use of cold and hot water tanks 16 and 17. The cold/hot water side of attachment 43 has the proximal end of a flexible hose 44 communicating therewith. The distal end of the hose adapted for connection to a conduit 45, contained in the cabinet, by means of a quick disconnect coupling 46. As further shown in FIG. 3, the distal end of conduit 45 is connected to distribution valve 29 whereby cold, hot or a mixture of cold and hot water can be communicated to sprayer attachment 18 under control of handle knob 19. Check valves 32 and 33 will prevent such water from being communicated to tanks 16 and 17.

Faucet attachment 43 has the proximal end of a second hose 47 connected to the drain side thereof. The distal end of hose 47 is adapted for connection to conduit 42 by means of a quick disconnect coupling 48. Activation of pump 40 will then function to purge and empty waste tank 23 sequentially through conduit 41, pump 40, conduit 42, hose 47, faucet attachment 43 and a sink 49. During such purging, hose 44 is preferably connected to conduit 45 and hot water is sprayed into basin 14 by sprayer attachment upon opening of spout 24 and appropriate manipulation of handle knob 19, for the purpose of cleansing waste tank 14. It should be understood that quick disconnect couplings could also be used to connect the distal end of flexible hose 44 within each fill pipe 25 and 27 to facilitate the filling of tanks 16 and 17 by hose 44.

Figure 4:
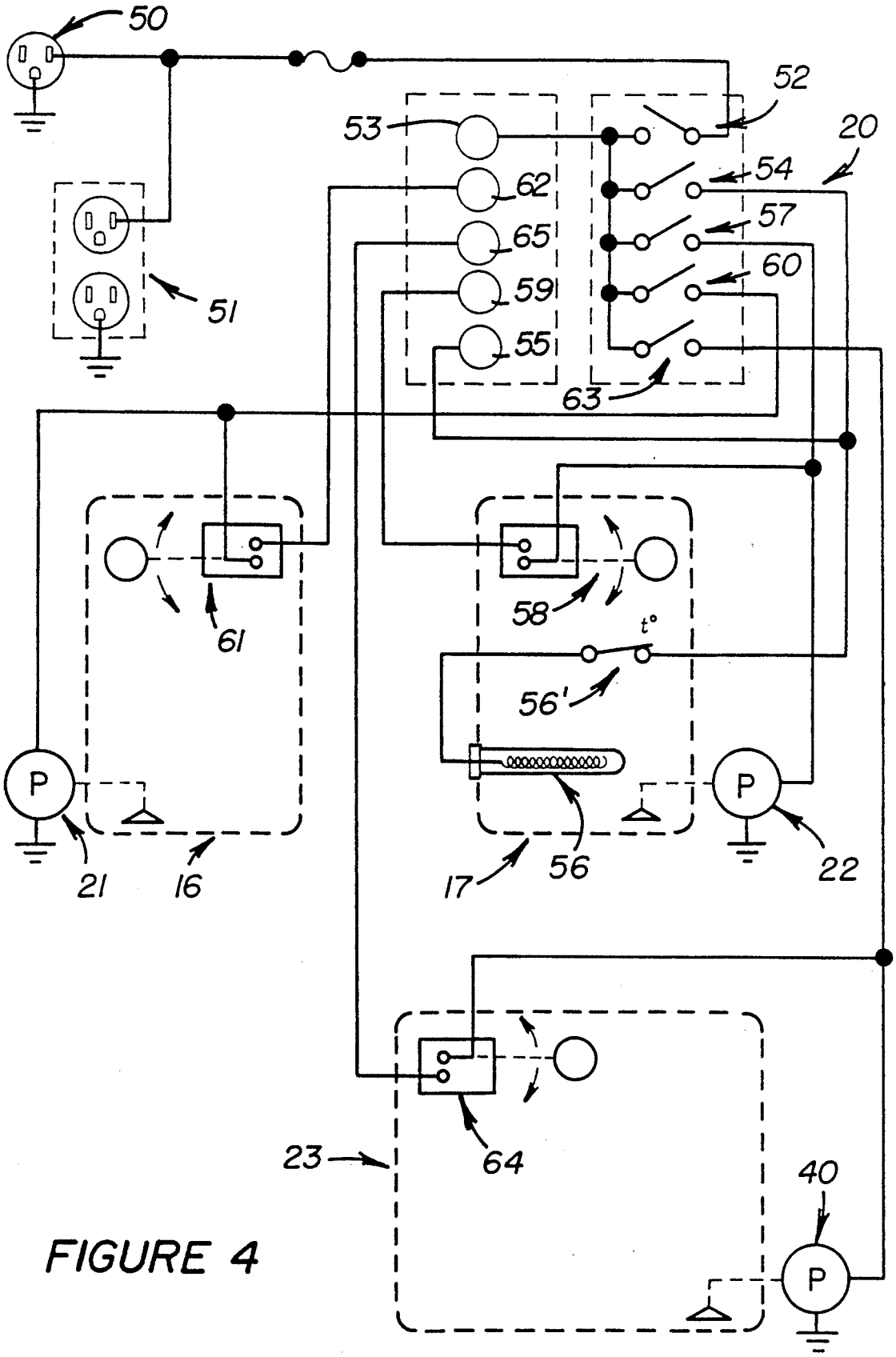
FIG. 4 diagrammatically illustrates an electrical control system employed in the water supply control system of this invention.
Figure 4:
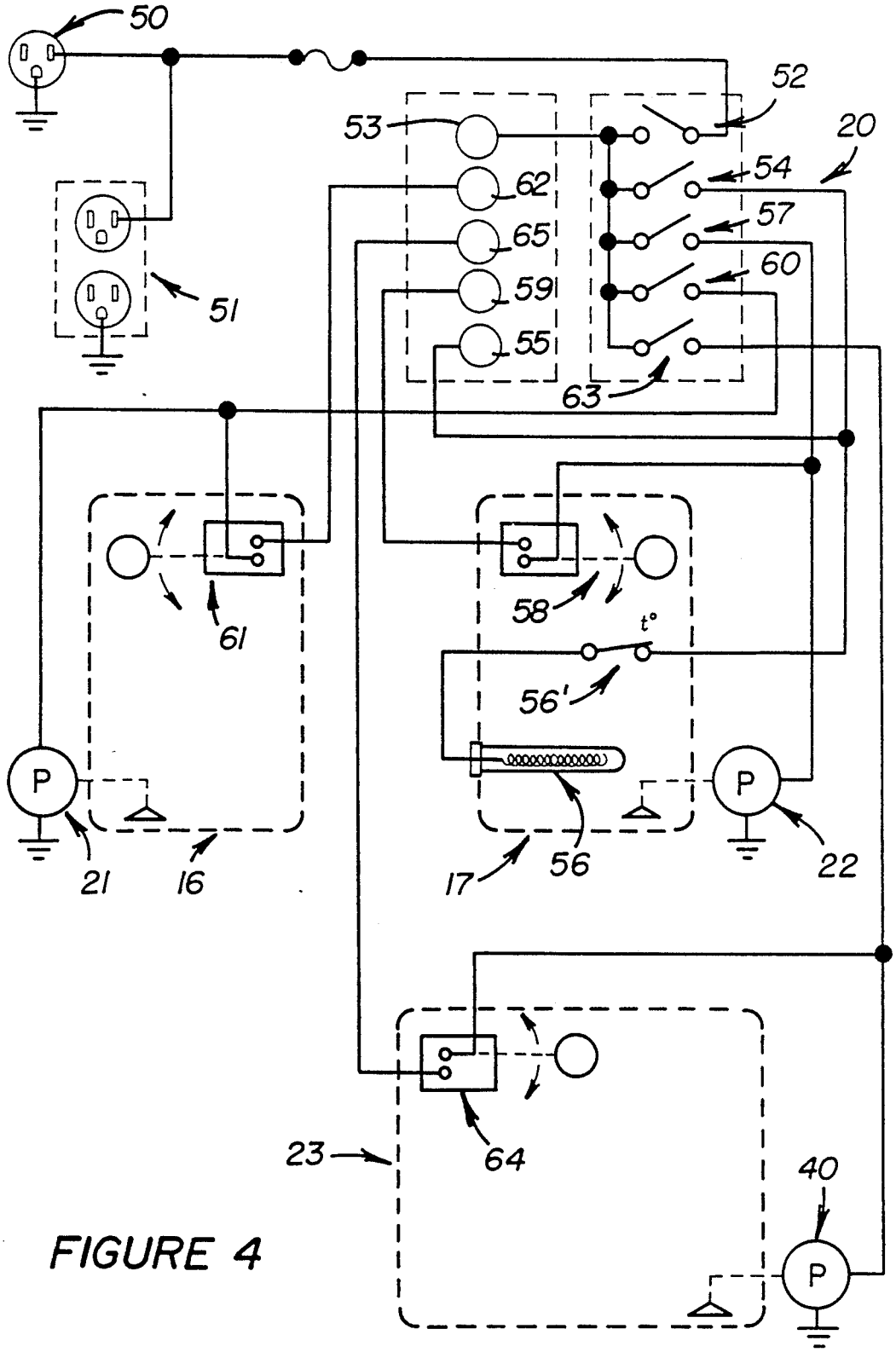

FIG. 4 diagrammatically illustrates an electrical circuit adapted to control various functions of mobile hygiene cabinet 10. A main socket 50 is mounted on a side of the cabinet, as shown in FIG. 1, and is adapted to be connected to a standard 110v power source by an extension cord in a conventional manner. Auxiliary sockets 51 are adapted to be connected to a standard blow dryer, curling iron, electric razor, etc. as needed for the grooming of a patient.

The electrical control system further comprises a main switch 52, preferably mounted on a side of the cabinet adjacent to main socket 50 (FIG. 1). A light 53 is positioned adjacent to the switch to indicate when the switch has been closed to its "on" position. When the main switch is closed, the switches of switch and light panel 20 (FIG. 2) are ready for closing to electrically activate working components of the mobile hygiene cabinet.

Closing of a switch 54 in FIG. 4 will function to illuminate a light 55 and also energize a standard heating element 56, contained in hot water tank 17, under automatic control of a standard thermal switch 56'. Closing of a switch 57 will function to energize pump 22 to communicate hot water to distribution valve 29 (FIG. 3). Simultaneously therewith, a water level sensor 58, preferably mounted in the bottom of tank 17, will be readied for illuminating a light 59 when the water level in tank 17 falls below a predetermined minimum level, requiring replenishment.

Closing of a switch 60 will function to activate pump 21 to communicate relatively cold water from tank 16 to distribution valve 29 (FIG. 3). A water level sensor 61 is preferably mounted on a bottom of tank 16 to sense when the water level therein falls below a predetermined minimum to illuminate a light 62 for this purpose.

The closing of a switch 63 will function to activate waste pump 40 to purge tank 23 of waste water in the manner described above. A waste water level sensor 64 is preferably mounted at an upper end of waste tank 23 to indicate when the level of waste water exceeds a predetermined maximum, i.e., when the tank is at least substantially full thus requiring emptying. The sensor is likewise connected to a light 65 on switch and light panel 20 (FIG. 2) to indicate this full condition of the waste tank.

From the above description, it can be seen that applicant has provided a highly stable, mobile, hygienic and economical self-contained cabinet, particularly useful for the caring of bed-ridden patients in hospitals and the like. As shown in FIGS. 2 and 3, the central disposition of tanks 16 and 17 within the cabinet and the disposition of tank 23 closely adjacent to the bottom of the cabinet provides a highly stabilized unit. In particular, the weight of the water (62.4 lbs./cu. ft.) will place the center of gravity of the unit at a near center, low position to prevent the unit from tippingover.

As shown in FIGS. 1 and 2, a push handle 66 is preferably secured on an upper end of the backside of the cabinet and a footrest 67 is mounted on a lower end thereof. Casters 13 are mounted forwardly on a combined footrest and crash bar 68, attached to a lower end of the front side of the cabinet.

It should be understood that various modifications can be made to the mobile hygiene cabinet of this invention without departing from the spirit of the invention hereof. For example, various access panels (e.g., 69 and 70), doors and storage compartments could be built into the cabinet to provide ready access to needed grooming and medical supplies. Footrest could be constructed as a brake pedal, pivotally mounted on the cabinet to actuate a standard braking mechanism (not shown) connected to wheels 12 to brake and lock the wheels when the brake pedal is depressed.

I claim:

1. A self-contained mobile hygiene cabinet having a front, back and lateral sides comprising a housing assembly mounted on a plurality of wheels, casters or the like, a wash basin mounted on a top of said cabinet, first tank means mounted in said cabinet for retaining a predetermined quantity of relatively cold water therein, second tank means mounted in said cabinet for retaining a predetermined quantity of relatively hot water therein,. said first and second tank means mounted in side-to-side relationship and centrally within said cabinet, third tank means communicating with said basin for receiving waste waters therefrom, said third tank means mounted below said first and second tank means and closely adjacent to a bottom of said cabinet, water dispensing means mounted on said cabinet, adjacent to said basin, for receiving and dispensing water therefrom, water distribution means for selectively communicating water to said water dispensing means, each of said first tank means and said second tank means being connected to said distribution means by a pump, first means mounted on said cabinet and leading a supply conduit connected to said water distribution means for connecting a hose of an external water source thereto, said distribution means will selectively communicate cold water from said first tank means, hot water from said second tank means or a mixture of cold and hot water from a conventional pressurized mixing faucet external of said cabinet, to said water dispensing means such that said cabinet may be used in a location near a pressurized water source via said first means or remote from a water source via said first and second tank means, second means mounted said cabinet and connected to an exhaust conduit connected to said third tank means for connecting a hose thereto for purging waste waters from said third tanks means, and pump means mounted in said cabinet for pumping waste water from said third tank means through said exhaust conduit.

2. The mobile hygiene cabinet of claim 1 further comprising a fill pipe connected to each of said first and second tank means and terminating at capped open ends thereof positioned and exposed at opposite lateral sides of said cabinet.

3. The mobile hygiene cabinet of claim 1 wherein said water dispensing means comprises a sprayer attachment and a single reciprocal and rotatable handle means, communicating with said sprayer attachment and each of said first and second tank means, for selectively communicating cold and/or hot water to said sprayer attachment.

4. The mobile hygiene cabinet of claim 1 means and said further comprising electrical control means for selectively activating each said first and second pumps for selectively communicating water to said water dispensing means.

5. The mobile hygiene cabinet of claim 4 further comprising check valve means connected between said water dispensing means and each of said first and second pumps for blocking counterflow of water from said water dispensing means to each of said first and second pumps.

6. The mobile hygiene cabinet of claim 4 wherein said electrical control means comprises first and second switch means, mounted in exposed relationship on said cabinet, for selectively connecting an electrical power source to said first and second pumps, respectively.

7. The mobile hygiene cabinet of claim 6 further comprising water level sensing means, mounted in each of said first and second tank means and connected to each of said first and second switch means, for sensing when the water level in each of said first and second tank means falls below a predetermined level.

8. The mobile hygiene cabinet of claim 7 further comprising automatically controlled heating element means mounted in said second tank means for maintaining the water therein at a predetermined temperature level and third switch means for selectively connecting said electrical power source to said heating element means.

9. The mobile hygiene cabinet of claim 6 further comprising third switch means for selectively activating said pump means.

10. The mobile hygiene cabinet of claim 9 further comprising water level sensing means, mounted in said third tank means and connected to said third switch means, for sensing when the waste water level in said third tank means exceeds a predetermined level.

11. The mobile hygiene cabinet of claim 8 or 9 wherein each of said first, second and third switch means has a light connected thereto that illuminates when a respective one of said switch means is placed in an "on" position and wherein each switch means and light is mounted on a switch and light panel mounted exteriorly on said cabinet.

12. The mobile hygiene cabinet of claim 1 wherein said first means and said second means comprise quick disconnect fittings.

* * * * *